US006581356B2

(12) United States Patent
Kim

(10) Patent No.: US 6,581,356 B2
(45) Date of Patent: Jun. 24, 2003

(54) TABLET DISPENSING AND PACKAGING SYSTEM

(76) Inventor: Jun H. Kim, 100-23, Galsandong, Dalsuhgu, Taegu (KR)

( * ) Notice: Subject to any disclaimer, the term of this patent is extended or adjusted under 35 U.S.C. 154(b) by 94 days.

(21) Appl. No.: 09/960,140

(22) Filed: Sep. 24, 2001

(65) Prior Publication Data

US 2003/0057231 A1 Mar. 27, 2003

(51) Int. Cl.[7] ..... B65B 35/54

(52) U.S. Cl. ..... 53/154; 221/119; 221/124; 221/133; 414/404

(58) Field of Search ..... 221/119, 121, 221/123, 124, 133, 129; 53/154; 414/404

(56) References Cited

U.S. PATENT DOCUMENTS 1,270,756 A * 6/1918 Holmberg ..... 414/404
2,255,036 A * 9/1941 Gedge ..... 119/322
5,588,792 A * 12/1996 Tiso ..... 414/404
5,709,063 A * 1/1998 Yuyama et al. ..... 53/154
6,050,064 A * 4/2000 Yuyama et al. ..... 53/514
6,318,051 B1 * 11/2001 Preiss ..... 53/493
6,449,921 B1 * 9/2002 Kim ..... 53/154

* cited by examiner

*Primary Examiner*—Donald P. Walsh
*Assistant Examiner*—Daniel K Schlak
(74) *Attorney, Agent, or Firm*—Park & Sutton LLP; John K. Park

(57) ABSTRACT

A tablet dispensing and packaging system includes a drum unit accommodating tablet cassettes open to tablet channels. A base tray slides in and out underneath the drum unit. First openings are formed through upper and lower surfaces of the base tray and a first membrane having pores is slidably provided on the lower surface. A removable tray has second openings therethrough a second membrane having pores is slidably provided on the lower surface of the removable tray to either keep tablets in the second openings thereby or drop the tablets through the pores thereof when slidably displaced to a predetermined extent. The removable tray is detachably mountable on the slid-out base tray.

8 Claims, 4 Drawing Sheets

TABLET DISPENSING AND PACKAGING SYSTEM

BACKGROUND OF THE INVENTION

The invention relates to a pharmaceutical tablet dispensing system. More particularly, the present invention relates to a tablet dispensing and packaging system that substantially improves tablet dispensing efficiency when processing such tablets as half-split pills and quarter-split pills.

An automatic tablet dispensing and packaging system is generally provided with a tablet packaging portion and a tablet dropping portion placed above the packaging portion. The table dropping portion includes tablet cassettes each storing therein and dropping therefrom a predetermined set of tablets. For an additional tablet dispensing operation, the known tablet dispensing system selectively includes a tablet tray that slides in and out from underneath the tablet dropping portion. The tablet tray accommodates extra tablets that are not appropriate to get stored in the tablet cassettes, such as half-split pills and quarter-split pills.

In order to fill the tablet tray with tablets, a system operator or a pharmacist is supposed to draw out the tray slidably attached to the system and fill out small openings within the tray with required tablets. At this time, since tablet bottles should be ready for tablet fill-out near the system usually distanced from tablet bottle storages or cabinets, the system operator or pharmacist has to disadvantageously wait until the tray becomes empty while suffering substantial labor from manual tablet distribution into the small openings.

Accordingly, a demand is to decrease a time interval between tablet loadings in the tray and improve efficiency as to the tablet distribution in the tray openings of the tablet tray.

SUMMARY OF THE INVENTION

An object of the present invention is to provide a tablet dispensing and packaging system that substantially improves tablet distribution efficiency when processing such tablets as half-split pills and quarter-split pills.

Another object is to substantially relieve a system operator or a pharmacist of laborious tablet distribution management by providing removable tablet trays and without requiring that tablet bottles or cabinets be moved close to the system each time tablets are being distributed on the tablet tray.

To achieve the above-described objects, an automatic tablet dispensing and packaging system according to the present invention comprises a drum unit accommodating a plurality of tablet cassettes communicating with elongated tablet channels to allow tablets in the tablet cassettes to selectively fall through the elongated tablet channels. The system also comprises a base tray defined by an upper surface, a lower surface and a thickness to slide in underneath the drum unit and slide out from underneath the drum unit. A plurality of first openings are formed through the upper and lower surfaces of the base tray. A first membrane having first pores is slidably provided on the lower surface of the base tray to either keep tablets in the first openings thereby or drop the tablets through the pores thereof when slidably displaced to a predetermined extent.

In an embodiment, the system includes a removable tray defined by a top surface, a bottom surface and a thickness. A plurality of second openings are formed through the top and bottom surfaces of the removable tray. A second membrane having second pores is slidably provided on the lower surface of the removable tray to either keep tablets in the second openings thereby or drop the tablets through the second pores thereof when slidably displaced to a predetermined extent. The removable tray is detachably mountable on the slid-out base tray.

A lever may be attached to the removable tray to control a sidewise slide of the second membrane so that a manipulation of the lever allows the tablets kept by the second membrane in the second openings to fall down through the second pores into the corresponding first openings of the base tray, in accordance with the lever manipulation. Further provided is a tablet packaging unit having a hopper disposed below the guide channels and the first membrane. The hopper congregates the tablets from the drum unit and the base tray unit to facilitate a tablet packaging using a packaging paper.

The base tray has at least two recesses formed in the upper surface thereof, and at least two protrusions corresponding to the recesses are attached on the bottom surface of the removable tray, so as to facilitate a vertical alignment of the first openings of the base tray and the corresponding second openings of the removable tray when the movable tray is mounted on the base tray.

The advantages of the present invention are numerous in that: (1) the removable tray in combination with the base tray serves to substantially decrease a time interval between tablet loadings in the base tray, thereby advantageously relieving a system operator or a pharmacist of waiting time until the filled-out base tray becomes empty; (2) the present invention enables the system operator or pharmacist to work on the removable tray for tablet distribution at a convenient location near tablet bottles and bottle cabinets and to easily transfer the tablet-filled removable tray onto the base tray while maintaining the system vicinity clear of equipment, thereby overcoming hygienic vulnerability around the system; and (3) the lever that controls the tablet dropping from the removable tray to the base tray is easily manipulated such that the system operator or pharmacist can simultaneously perform the removable tray movement and the tablet dropping from the removable tray to the base tray, thereby improving product reliability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
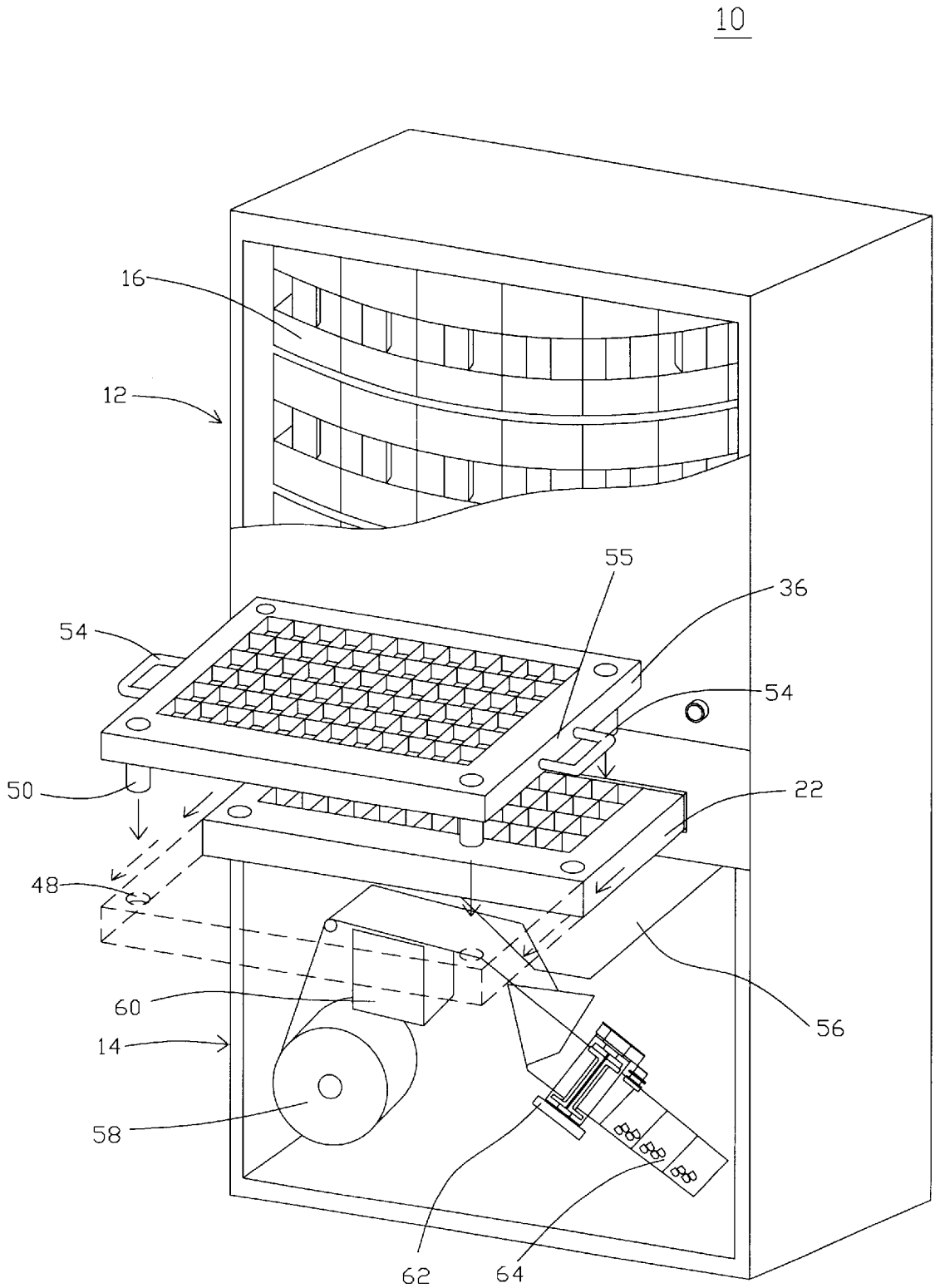
FIG. 1 is a perspective overall view of a tablet dispensing and packaging system according to the present invention.
Figure 2:
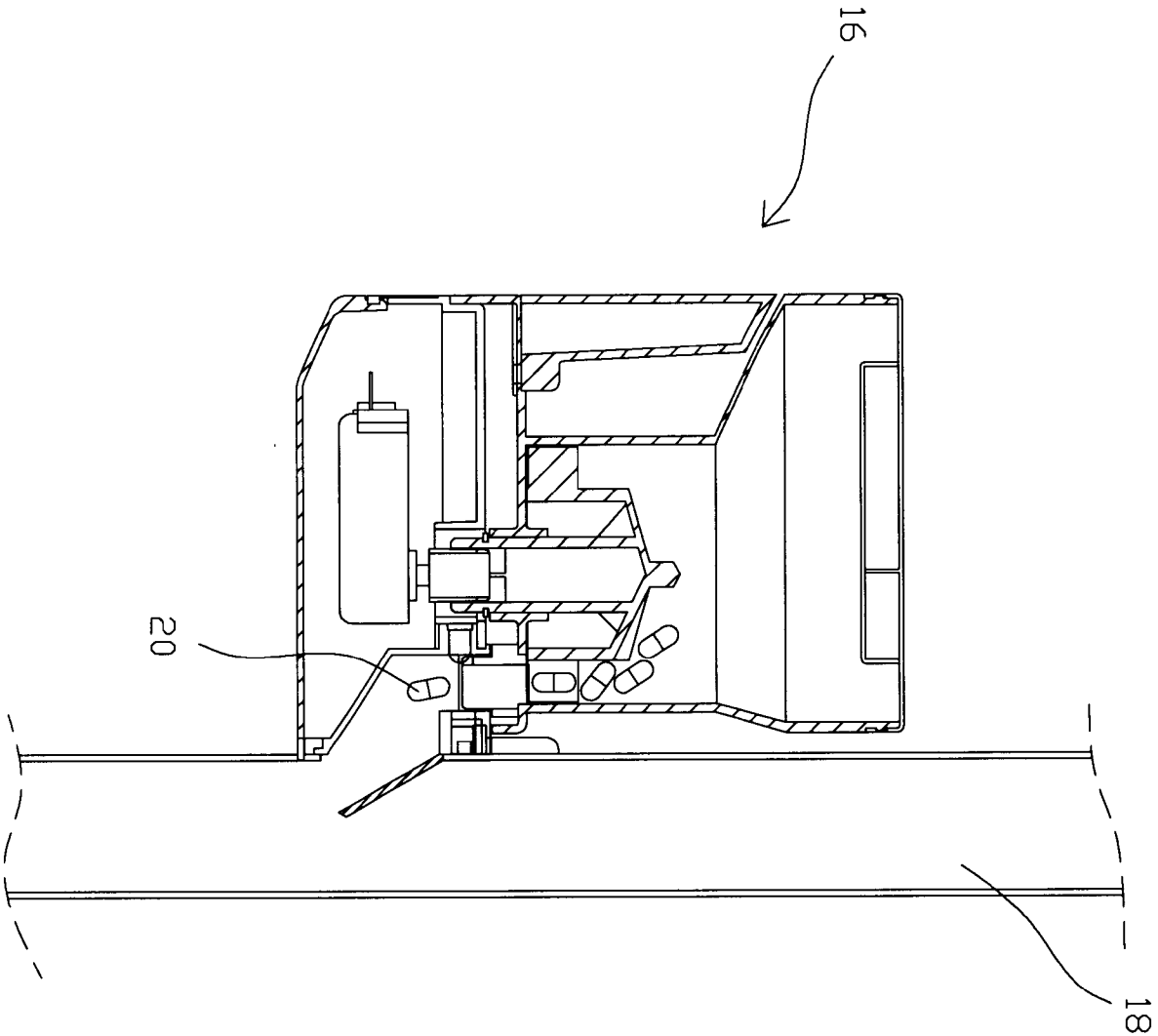
FIG. 2 is a cross-sectional view showing a mechanism of a tablet cassette and tablet channel according to the present invention.

As shown in FIGS. 1 and 2, a tablet dispensing and packaging system 10 according to the present invention comprises a drum unit 12 and a tablet packaging unit 14 below the drum unit 12. The drum unit 12 accommodates a plurality of tablet cassettes 16 each communicating with an elongated tablet channel 18. The elongated tablet channel 18 allows regular tablets 20 in each tablet cassette 16 to selectively fall therethrough.

Figure 3:
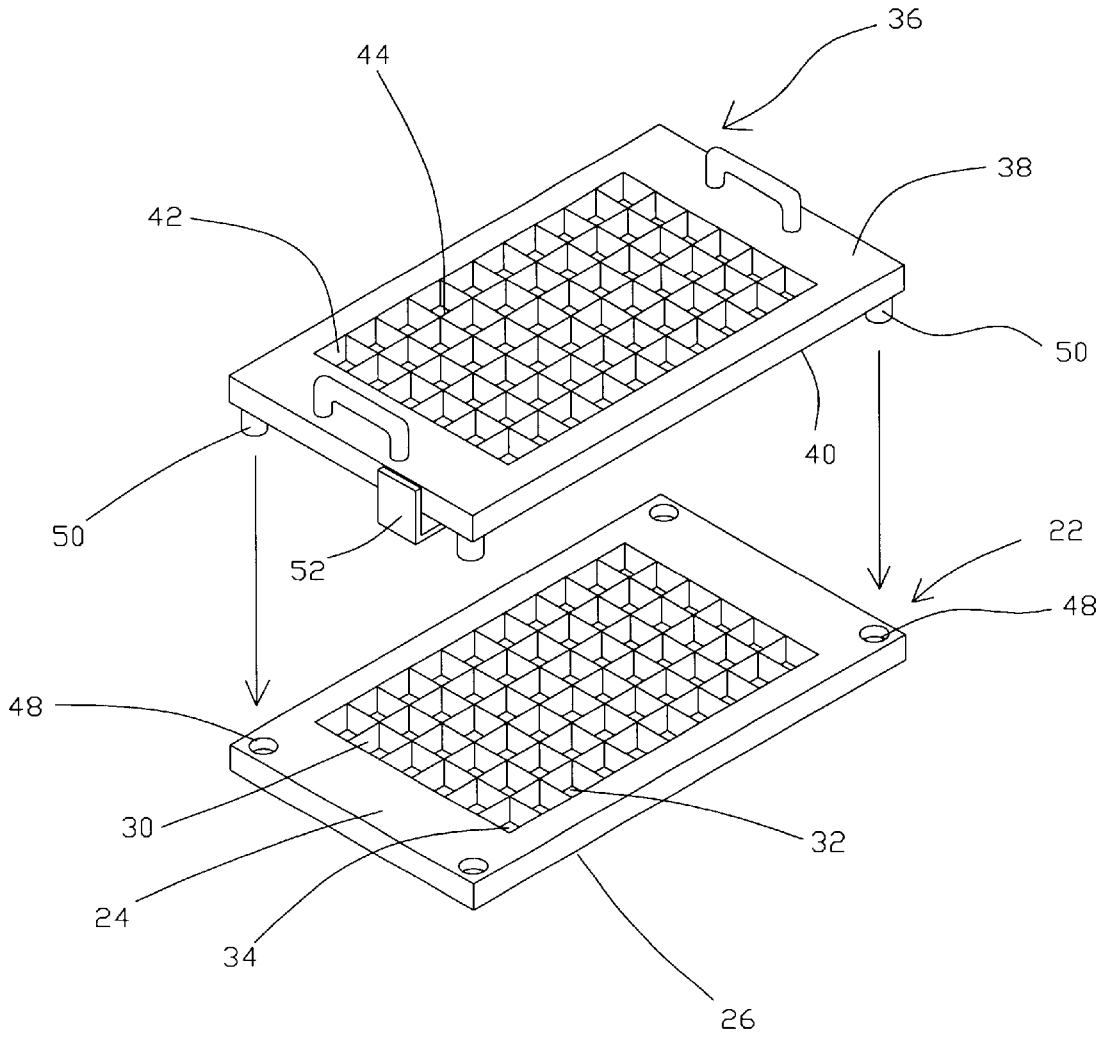
FIG. 3 is an operational view showing a removable tray being mounted on a base tray according to the present invention.
Figure 4:
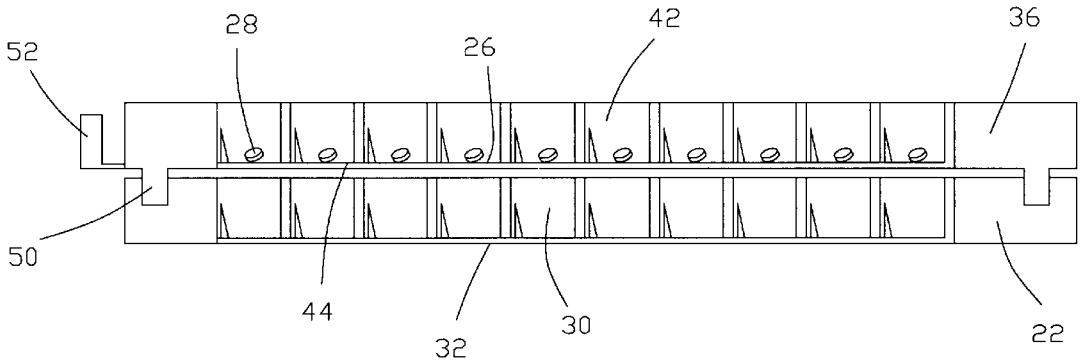
FIG. 4 is a cross-sectional view of the removable tray mounted on the base trays according to the present invention.
Figure 5:
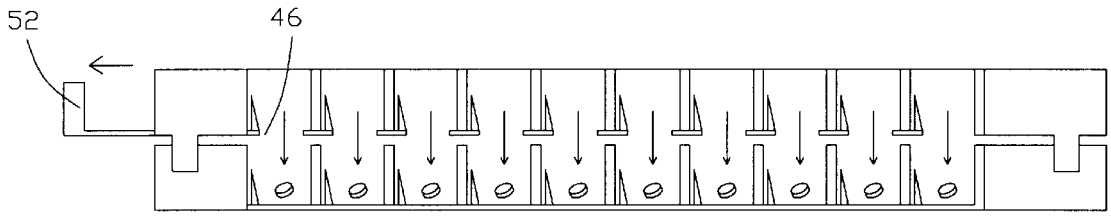
FIG. 5 is a cross-sectional operation view showing tablets being dropped by a lever manipulation according to the present invention.
Figure 6:
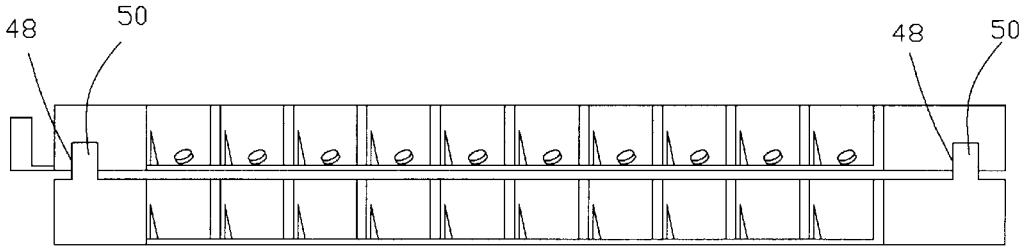
FIG. 6 is a cross-sectional view of a removable tray mounted on a base tray according to another embodiment of the present invention.

For an extra tablet provision, a base tray 22 is slidably disposed between the drum unit 12 and the tablet packaging unit 14. Extra tablets 28 as illustrated in FIGS. 4–6 include half-split pills, quarter split-pills, custom-split pills in accordance with a doctor's prescription, and other possible tablet provision, in addition to regular tablets. As further shown in FIG. 3, the base tray 22 is defined by an upper surface 24, a lower surface 26 and a thickness between the upper surface 24 and the lower surface 26. The base tray 22 is supposed to slide in underneath the drum unit 12 and slide out from underneath the drum unit 12.

In order to temporarily store the extra tablets 28, a plurality of first openings 30 are formed through the upper and lower surfaces 24, 26 of the base tray 22. To enable the extra tablets 28 to temporarily remain in the first openings 30, there is disposed a first membrane 32 slidably provide on the lower surface 26 of the base tray 22 to either keep tablets 28 in the first openings 30 thereby or drop the tablets 28 through first pores 34 thereof when the first membrane 32 is slidably displaced to a predetermined extent. That is, when the first pores 34 become communicating with the first openings 30 of the base tray 22, the extra tablets 28 come to fall down from the first openings 30 through the displaced first pores 34 of the first membrane 32.

In correspondence to the base tray 22, the system 10 further includes at least one removable tray 36. The removable tray 36 is defined by a top surface 38, a bottom surface 40 and a thickness between the top surface 38 and the bottom surface 40. A plurality of second openings 42 are formed through the top and bottom surfaces 38, 40 of the removable tray 36. In order to enable the second openings 42 to serve as temporary storages, there is disposed a second membrane 44 slidably provided on the lower surface 40 of the removable tray 36 to either keep tablets 28 in the second openings 42 thereby or drop the tablets 28 through second pores 46 thereof when the second membrane 44 is slidably displaced to a predetermined extent. Preferably, the removable tray 36 is about 0.4 inches to 1.0 inches in the thickness between the top surface 38 and the bottom surface 40. Also preferred is a dimension in which the base tray 22 equals the removable tray 36 in thickness.

Specifically, when the second pores 46 become communicating with the second openings 42 of the removable tray 36, the extra tablets 28 distributed over the removable tray 36 come to fall down from the second openings 42 through the displaced second pores 46 of the second membrane 44. As specified in the accompanying drawings, the removable tray 36 is detachably mountable on the slid-out base tray 22. In order to realize an accurate mounting of the removable tray 36 on the slid-out base tray 22, the base tray 22 may be provided with at least two recesses 48 formed in the upper surface 24 thereof, and at least two protrusions 50 corresponding to the recesses 48 are attached on the bottom surface 40 of the removable tray 36, so as to facilitate a vertical alignment of the first openings 30 of the base tray 22 and the corresponding second openings 42 of the removable tray 36 when the removable tray 36 is mounted on the base tray 22.

Alternately, as shown in FIG. 6, the removable tray 36 may have at least two recesses 48 formed in the bottom surface 40 thereof, and at least two protrusions 50 corresponding to the recesses 48 of the removable tray 36 may be attached on the upper surface 24 of the base tray 22, thereby substantially facilitating a vertical alignment of the first openings 30 of the base tray 22 and the corresponding second openings 42 of the removable tray 36 when the removable tray 36 is mounted on the base tray 22.

In order to easily manipulate the second membrane 44, a lever 52 is attached to the removable tray 36 to control a sidewise slide of the second membrane 42 so that a manipulation of the lever 52 allows the tablets 28 kept by the second membrane 44 in the second openings 42 to fall down through the second pores 46 into the corresponding first openings 30 of the base tray 22, in accordance with the lever manipulation. The lever 52 may be operated using a finger of the operator.

That is, the lever serves to drag the second membrane 44 to a predetermined extent so that the second pores 46 of the second membrane 44 can communicate with the second openings 42, whereby the tablets become dropped the moment the lever 52 is dragged or pulled slightly by the system operator or pharmacist. The lever dragging is implemented when the removable tray 36 is accurately mounted on the base tray 22. Here, the recesses 48 and protrusions 50 determine the accurate mounting of the removable tray 36 on the base tray 22.

In a preferred version, a handle 54 is formed on each side edge portion 55 of the removable tray 36 to facilitate manipulation and movement of the removable tray 36.

For a better performance, the tablet packaging unit 14 includes a hopper 56. The hopper 56 is disposed below the guide channels 18 and the first membrane 32. The hopper 56 congregates the tablets 20, 28 from the drum unit 12 and the base tray 22 to facilitate a tablet packaging using a packaging paper 58. The tablet packaging unit 14 further includes a printer 60 to print respective information on the packaging paper 58, a heater assembly 62 to package the tablets 20, 28 released through the hopper 56 into one or more partitioned paper bags 64 using the packaging paper 58.

An advantage of the present invention is that the removable tray 36 in combination with the base tray 22 serves to substantially decrease a time interval between tablet loadings in the base tray 22, thereby advantageously relieving a system operator or a pharmacist of waiting time until the filled-out base tray 22 becomes empty or released down into the hopper 56. Further, the present invention enables the system operator or pharmacist to work on the removable tray 36 for tablet distribution at a convenient location near tablet bottles and bottle cabinets and to easily transfer the tablet-filled removable tray 36 onto the base tray 22 while maintaining the system vicinity clear of equipment, thereby overcoming hygienic vulnerability around the system 10. In addition, the finger-operable lever 52 that controls the tablet dropping from the removable tray 36 down to the base tray 22 is easily manipulated such that the system operator or pharmacist can simultaneously perform the removable tray movement and the tablet dropping from the removable tray to the base tray, thereby improving product reliability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A tablet dispensing and packaging system, comprising:

a) a drum unit accommodating a plurality of tablet cassettes communicating with elongated tablet channels to allow tablets in the tablet cassettes to selectively fall through the elongated tablet channels;

b) a base tray defined by an upper surface, a lower surface and a thickness to slide in underneath the drum unit and slide out from underneath the drum unit, wherein a plurality of first openings are formed through the upper and lower surfaces of the base tray, wherein a first membrane having first pores is slidably provided on the lower surface of the base tray to either keep tablets in the first openings or drop the tablets through the pores in the first membrane when slidably displaced to a predetermined extent;

c) a removable tray defined by a top surface, a bottom surface and a thickness, wherein a plurality of second openings are formed through the top and bottom surfaces of the removable tray, wherein a second membrane having second pores is slidably provided on the lower surface of the removable tray to either keep tablets in the second openings or drop the tablets through the second pores when slidably displaced to a predetermined extent, wherein the removable tray is detachably mountable on the slid-out base tray;

d) a lever attached to the removable tray to control a sidewise slide of the second membrane so that a manipulation of the lever allows the tablets kept by the second membrane in the second openings to fall down through the second pores into the corresponding first openings of the base tray, in accordance with the lever manipulation; and e) a tablet packaging unit having a hopper disposed below the guide channels and the first membrane, wherein the hopper congregates the tablets from the drum unit and the base tray unit to facilitate a tablet packaging using a packaging paper.

2. The system of claim 1, wherein the base tray has at least two recesses formed in the upper surface thereof, and at least two protrusions corresponding to the recesses are attached on the bottom surface of the removable tray, so as to facilitate a vertical alignment of the first openings of the base tray and the corresponding second openings of the removable tray when the removable tray is mounted on the base tray.

3. The system of claim 2, wherein a handle is formed on each side edge portion of the removable tray to facilitate manipulation and movement of the removable tray.

4. The system of claim 1, wherein the removable tray has at least two recesses formed in the bottom surface thereof, and at least two protrusions corresponding to the recesses are attached on the upper surface of the base tray, so as to facilitate a vertical alignment of the first openings of the base tray and the corresponding second openings of the removable tray when the removable tray is mounted on the base tray.

5. The system of claim 4, wherein a handle is formed on each side edge portion of the removable tray to facilitate manipulation and movement of the removable tray.

6. The system of claim 1, wherein the base tray thickness equals the removable tray thickness.

7. The system of claim 6, wherein the removable tray is about 0.4 inches to 1.0 inches in thickness.

8. The system of claim 1, wherein the tablet packaging unit further comprises:

a) a printer to print respective information on the packaging paper; and b) a heater assembly to package the tablets released through the hopper into one or more partitioned paper bags using the packaging paper.

* * * * *